US008721269B2

(12) United States Patent
Abadie et al.

(10) Patent No.: US 8,721,269 B2
(45) Date of Patent: May 13, 2014

(54) VARIABLE-PITCH VANE FOR STATOR STAGE, INCLUDING A NON-CIRCULAR INNER PLATFORM

(75) Inventors: Aude Abadie, Saint Fargeau Ponthierry (FR); Claude Robert Louis Lejars, Draveil (FR)

(73) Assignee: SNECMA, Paris (FR)

( * ) Notice: Subject to any disclaimer, the term of this patent is extended or adjusted under 35 U.S.C. 154(b) by 422 days.

(21) Appl. No.: 13/143,652

(22) PCT Filed: Jan. 8, 2010

(86) PCT No.: PCT/EP2010/050128

§ 371 (c)(1),
(2), (4) Date: Jul. 7, 2011

(87) PCT Pub. No.: WO2010/079204

PCT Pub. Date: Jul. 15, 2010

(65) Prior Publication Data

US 2011/0293406 A1 Dec. 1, 2011

(30) Foreign Application Priority Data

Jan. 9, 2009 (FR) ..... 09 50104

(51) Int. Cl.
*F04D 29/56* (2006.01)

(52) U.S. Cl.
USPC ..... 415/160

(58) Field of Classification Search
USPC ..... 415/160, 162, 191
See application file for complete search history.

(56) References Cited

U.S. PATENT DOCUMENTS

| | | | | |
|---|---|---|---|---|
| 4,231,703 | A | 11/1980 | Weiler | |
| 4,950,129 | A * | 8/1990 | Patel et al. | 415/160 |
| 7,360,990 | B2 * | 4/2008 | Barbe et al. | 415/160 |
| 8,123,471 | B2 * | 2/2012 | Mielke et al. | 415/160 |
| 2006/0198982 | A1 | 9/2006 | Holland et al. | |
| 2006/0245916 | A1 | 11/2006 | Foucher | |
| 2008/0131268 | A1 | 6/2008 | Guemmer | |

FOREIGN PATENT DOCUMENTS

| | | | |
|---|---|---|---|
| EP | 0 384 706 | A1 | 8/1990 |
| EP | 1 705 341 | A2 | 9/2006 |
| EP | 1 705 341 | A3 | 9/2006 |
| EP | 1 717 450 | A2 | 11/2006 |
| EP | 1 717 450 | A3 | 11/2006 |

OTHER PUBLICATIONS

International Search Report issued Feb. 15, 2010 in PCT/EP2010/050128 (with English Translation of Category of Cited Documents).

* cited by examiner

*Primary Examiner* — Edward Look
*Assistant Examiner* — William Grigos
(74) *Attorney, Agent, or Firm* — Oblon, Spivak, McClelland, Maier & Neustadt, L.L.P.

(57) ABSTRACT

A variable-pitch vane for a stator stage includes an active part of the vane either side of which are positioned a radially inner platform and a radially outer platform, where the active part of the vane, which has a surface forming a convex surface, and a surface forming a concave surface, separate the platform into a part positioned on the convex side and a part positioned on the concave side. Seen along the direction of the vane's axis of rotation, the part has an outer outline superimposed on a circle, at the distance of which, and inside which, is at least a part of the outer outline of the part of the platform.

12 Claims, 4 Drawing Sheets

VARIABLE-PITCH VANE FOR STATOR STAGE, INCLUDING A NON-CIRCULAR INNER PLATFORM

TECHNICAL FIELD

The present invention relates generally to stator stages with variable-pitch vanes, where these vanes are designed to be fitted to turbomachine modules, of the compressor or turbine type.

The invention preferably applies to aircraft turbomachines, for example of the jet turbine or turboprop engine type.

STATE OF THE PRIOR ART

With reference to FIG. 1, a part of a high-pressure compressor for turbojet, of a known design of the prior art, can be seen. Compressor 1 includes, in traditional fashion, multiple stator stages 2*a*, 2*b*, 2*c*, and moving wheels (not represented). These elements, which are centred on axis 4 of the turbomachine, are designed to alternate in the axial direction, and are intended to be traversed by a principal air flow 6 flowing through this high-pressure compressor.

Each stator stage 2*a*, 2*b*, 2*c* includes multiple vanes 8, called variable-pitch vanes. Each of the vanes 8, which are distributed circumferentially around axis 4, has a head connected to an outer case 10 of the compressor, where this head habitually includes a radially outer platform 11 which is extended by a centring pin 12. The pin 12 is connected to a system 14 allowing the angle of attack of the vane 8 to be controlled, this system being mounted on the outer case 10. In a known manner, the system 14 is capable of controlling the angle of attack of all the vanes of its associated stator stage simultaneously.

With reference to FIG. 2, it can be seen that the vane 8 also has a base, which also habitually includes a radially inner platform 13 extended by a centring pin 16. This pin 16, the axis of which is identical to that of the pin 12, and which is also the axis 20 of the vane around which this vane can be pivoted in order to vary its angle of attack, is inserted in a stator vane ring 22.

The latter, which is generally made from several angular rings sectors, indeed has multiple orifices 24 distributed circumferentially, each one holding a bushing 26 for receiving a centering pin 16. In addition, these orifices 24 open respectively into other orifices 27 holding the platforms 13. In a known manner, in addition to holding the bushings 26 and the radially inner platforms 13, the stator vane ring 22 contributes to the construction of the inner surface demarcating the principal airstream traversed by the airflow 6.

Each bushing 26 has a skirt 28 inserted in one of the orifices 24 of the ring, and this skirt defines a centering pin seat 30, into which the pin 16 of the vane is inserted. In FIG. 2 it can be seen that the pin 16 is covered with an organ 32, preferably coupled with the latter, the function of which is to ease sliding in the skirt 28. In addition, the bushing 26 has a base 34 coupled with the skirt, and positioned radially towards the interior relative to the latter. The base 34 of each bushing rests in a circumferential groove 36 of the stator vane ring 22, providing, in a known manner, rotational blocking of this bushing.

Indeed, each base 34 is demarcated by two faces which face one another in the circumferential direction 40, and two faces which face one another in the axial direction 50, referenced 46 and 48. The two faces 46, 48, called the circumferential faces, are roughly flat and facing, respectively, two edges demarcating the groove 36, as shown in FIG. 2.

The design is such that faces 46, 48 are as close as possible, respectively, to the two facing groove edges, and spaced in the axial direction 50. Generally, only a working clearance is kept between the elements which face one another, two-by-two, in order to allow the bases 34 to be held in the circumferential groove 36 with the orifices 24.

With this standard configuration found in the prior art, when the angle of attack control system 14 drives the vanes 8 rotationally around rotational axes 20 in order to adjust the angle of attack to a precise angle, the centering pin 16 of each vane tends to pull the bushing 26 with it, rotationally, due to the frictional forces being exerted between the orifice 30 and the organ 32 surrounding the base 16.

This relative rotation of each bushing 26, in its axis 20, relative to the ring 22, is stopped by the consumption of the working clearances initially existing between the circumferential faces 46, 48 and the edges of the groove 36. When contact has been established between the faces 46, 48 of the base 34 and these groove edges, the relative rotation of the base is stopped, while the relative rotation of vane 8 relative to its bushing 26 and to the ring 22 can continue, in order to obtain the desired pitch.

Although this assembly 60 for a stator stage, including ring 22, bushings 26 and vanes 8, is found widely in the embodiments of the prior art, it nonetheless has a non-negligible disadvantage, namely the high degree of wear and tear of the parts involved. In particular, an extremely rapid degree of wear and tear of the groove edges occurs, impacted as they constantly are by the bases 34; the consequence of this wear and tear is to increase in a comparable proportion the rotational amplitude of the bushings whenever the angle of attack is changed, and therefore also to cause wear and tear to the other parts of the ring, such as those facing the skirts 28, causing widening by the wear and tear of orifice 24.

During operation, each vane 8 is subject to a deflection caused by the resultant of the aerodynamic forces being exerted on it. This consequence of this aerodynamic deflection, the amplitude of which is greater the greater the above-mentioned wear and tear of the holding orifices 24, is the creation of friction between the radially inner platform 13 and its corresponding holding orifice 27 in the ring 22.

Due to the alignment of the resultant of the aerodynamic forces being exerted on the vane, this friction is localised in the area of the part of the platform 13 located on the concave side 62 of the active part 43 of the vane, namely the part of the platform 13 facing the portion of the orifice having numerical reference 27 in FIG. 3.

The harmful consequence of this friction between the platform 13 of circular section and the wall of the holding orifice 27 is a rapid wear and tear of ring 22, which must consequently be replaced frequently.

Another consequence of this friction is to increase the stresses in the base of the active part of the vane on the concave side, which reduces the lifetime of the vanes, which cannot then have the lifetime of the engine.

SUMMARY OF THE INVENTION

The purpose of the invention is therefore to provide at least partially a solution to the disadvantages mentioned above, compared with the embodiments of the prior art.

In order to accomplish this, a first object of the invention is a variable-pitch vane for a stator stage of a turbomachine module, including an active part of the vane, either side of which are arranged a radially inner platform and a radially outer platform, and also including a first centering pin which extends radially towards the outside from the said radially outer platform, together with a second centering pin extending radially towards the inside from the said radially inner platform, where the said first and second centering pins define a common vane rotational axis, and where the said active part of the vane, which has a first surface forming a convex surface, and a second surface forming a concave surface, separates the said radially inner platform into a first part positioned on the side of the first vane surface and a second part positioned on the side of the second vane surface. According to the invention, seen along the direction of the vane's axis of rotation, the said first part of the radially inner platform has an outer outline superimposed on a circle, at the distance of which, and inside which, is at least a part of the outer outline of the said second part of the radially inner platform.

The invention is therefore designed, in an original fashion, such that it departs from the habitual circular section shape for the vane's radially inner platform. Indeed, the second part of the platform, namely that which is the most subject to friction in its holding orifice as a consequence of the vane's aerodynamic deflection, is therefore no longer circular, but has a peripheral shrinkage of material. This shrinkage enables it to be separated locally from the orifice holding the ring in which this platform is intended to be held, with the aim of reducing the friction with this orifice. Thus, since the ring is subject to less frictional stress by the radially inner platforms which it supports, its lifetime is advantageously increased. Similarly, the degree of stress in the vane remains identical to that intended when new, and the lifetime of the vane is therefore no longer affected.

Furthermore, the that this shrinkage of material is localised, and therefore not applied all around the radially inner platform, enables small clearances to be kept between the remaining portion of circular section and the orifice holding the ring in which this platform is intended to be held. This enables the aerodynamic flow traversing the vane to be affected only very slightly, due to minor aerodynamic recirculation phenomena observed.

The part of the outline of the radially inner platform, which is separated from the said circle, preferably extends over an angular sector of between 100 and 140°, centred on the centre of the said circle.

The part of the outline of the radially inner platform, which is separated from the said circle, is preferably located at a maximum radial distance from the said circle of between a value corresponding to 7% of the diameter of the circle, and a value corresponding to 1% of the diameter of this circle.

Another object of the invention is a stator stage assembly including multiple variable-pitch vanes such as those described above, where the said assembly includes a stator vane ring having, in association with each of the said vanes, an orifice holding the radially inner platform of the vane, opening out into the area of an inner surface demarcating a principal airstream defined by the ring, together with an orifice holding a centering bushing of the vane in which is inserted the said second centering pin such that, seen along a direction of the axis of rotation of the vane, the said orifice holding the radially inner platform has an inner outline superimposed on a concentric circle, of diameter greater than the said circle, on to which the outer outline of the said first part of the radially inner platform is superimposed.

Each radially inner platform also preferably forms a part of the said inner surface demarcating the principal airstream.

Each centering bushing preferably includes firstly a skirt inserted in the said bushing holding orifice in the ring, and defining a seat of the second centering pin, and secondly a base coupled with the said skirt, where the said bushings, each extending in a bushing axis, succeed one another in a circumferential direction of the said ring.

The base of each centering bushing is preferably held in a circumferential groove of the ring, demarcated by two facing edges spaced relative to one another in an axial direction of the ring.

Another object of the invention is a variable-pitch vane stator, for a turbomachine module, including an assembly as described above.

Another object of the invention, furthermore, is a turbomachine module including at least one stator stage as described above. With this regard, the module may be a compressor, preferably a high-pressure compressor, or a turbine.

Another object of the invention is a turbomachine including at least one module as described above.

A final object of the invention is also a method for manufacturing a variable-pitch vane for a turbomachine module stator stage, such as that described above, in which the said radially inner platform is obtained from a shape of circular section, machined in its periphery so as to obtain the said second part of this platform. Naturally, the vane according to the invention can be obtained according to any other method, without going beyond the scope of the invention. With this regard, the radially inner platform may be manufactured such that its final shape is obtained directly, for example by casting, without involving any transition through an intermediate shape of circular section.

Other advantages and characteristics of the invention will appear in the non-restrictive detailed disclosure below.

BRIEF DESCRIPTION OF THE DRAWINGS

This description will be made with reference to the attached illustrations, among which.

DETAILED DESCRIPTION OF PREFERRED EMBODIMENTS

Figure 4:
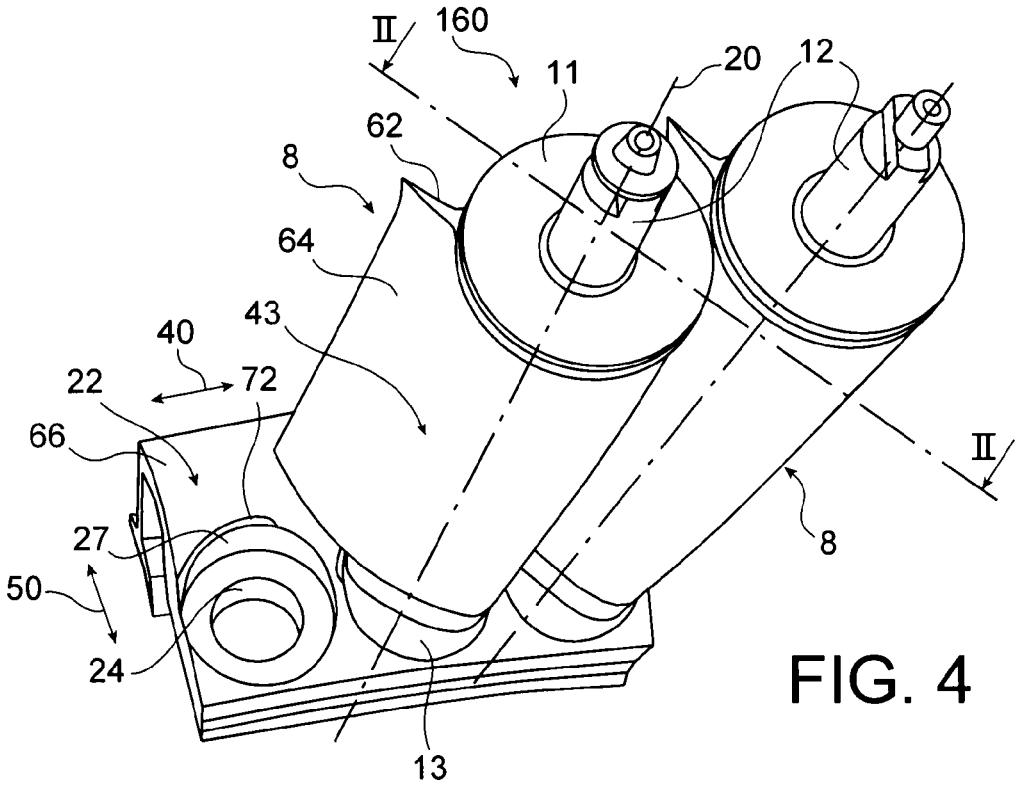
FIG. 4 represents a perspective view of a part of an assembly for a stator stage with variable-pitch vanes, according to a preferred embodiment of the present invention.

With reference to FIG. 4, a part of an assembly 160 according to a preferred embodiment of the present invention can be seen, in which this assembly 160 is intended to form an integral part of a variable-pitch blade stator stage, for a turbomachine module.

Figure 1:
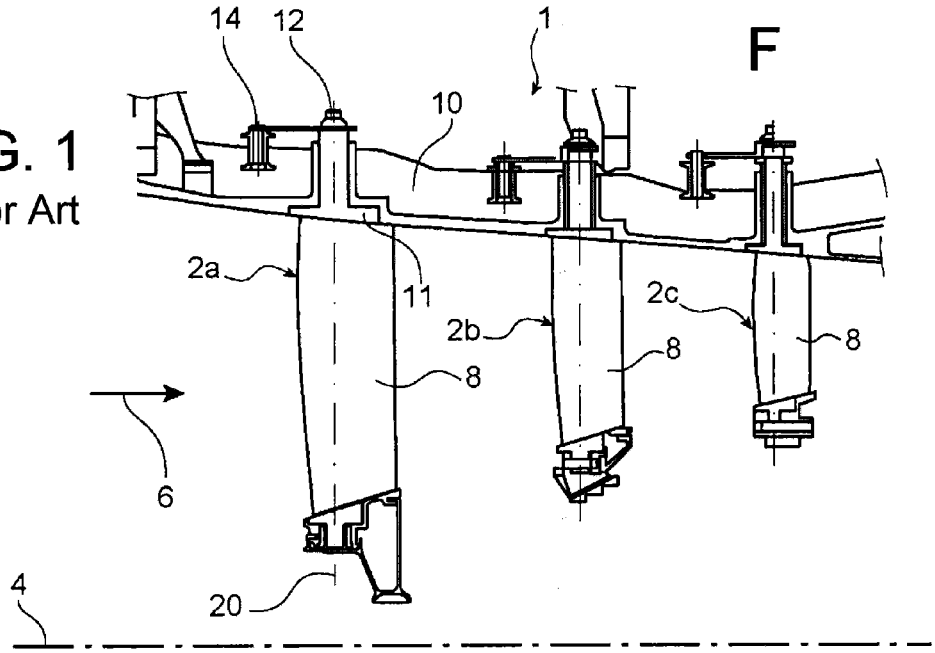
FIG. 1 Prior Art
FIG. 1, previously described, represents a partial lengthways half-section view of a high-pressure compressor of an aircraft turbomachine, according to a known embodiment of the prior art.

This first embodiment is designed to replace the previously described assembly 60 of the prior art, and therefore designed to be positioned within any of the stator stages 2*a*, 2*b*, 2*c* of the high-pressure compressor of FIG. 1. With this regard, it is noted that the assembly has, in a section along line II-II of FIG. 4, a shape identical or similar to that of the assembly 60 of FIG. 2. Moreover, in the figures, the elements bearing identical numerical references are identical or similar elements.

Thus, assembly 160 includes a stator vane ring 22 identical to the one described for the assembly 60 of the prior art. In particular, holding orifices 24, 27 are distributed regularly in the circumferential or tangential direction 40; the orifices 27 open out in the area of an inner surface demarcating a principal airstream 66 formed by the ring 22, and the orifices 24 open out in the area of the circumferential groove (not visible in FIG. 4), demarcated by the two facing groove edges spaced relative to one another in axial direction 50. This ring is, clearly, centred on the axis of the turbomachine.

Figure 2:
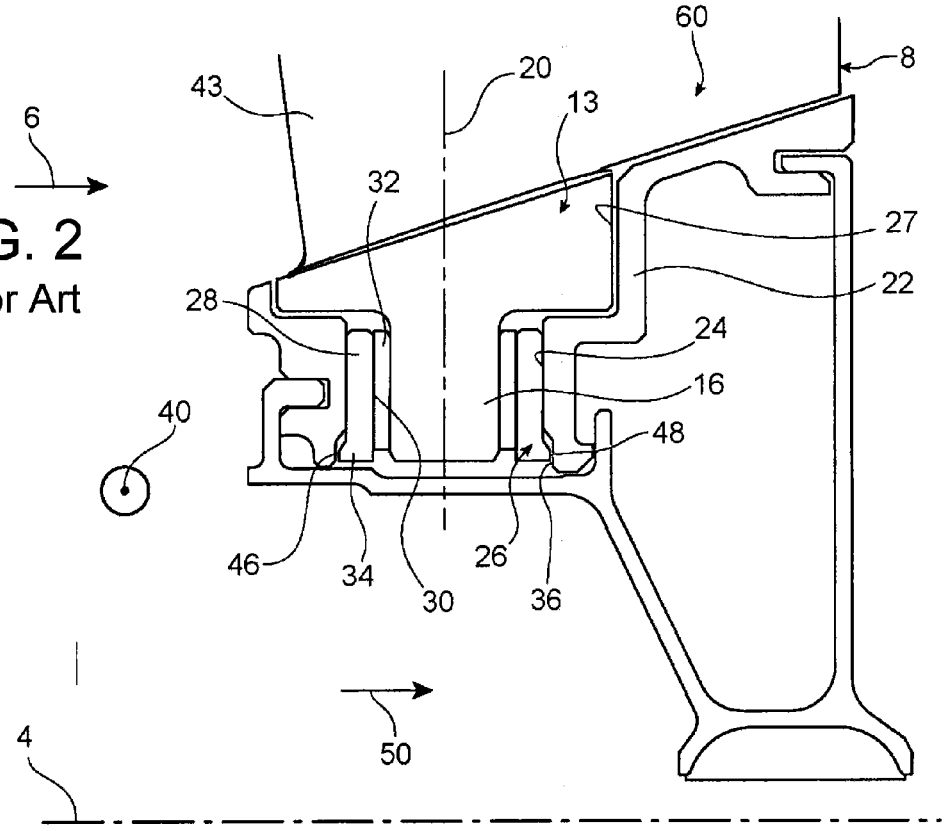
FIG. 2 Prior Art
FIG. 2, previously described, represents an enlarged lengthways half-section view of a part of a stator stage of the compressor of FIG. 1, showing the assembly of a stator vane base on a stator vane ring.
Figure 3:
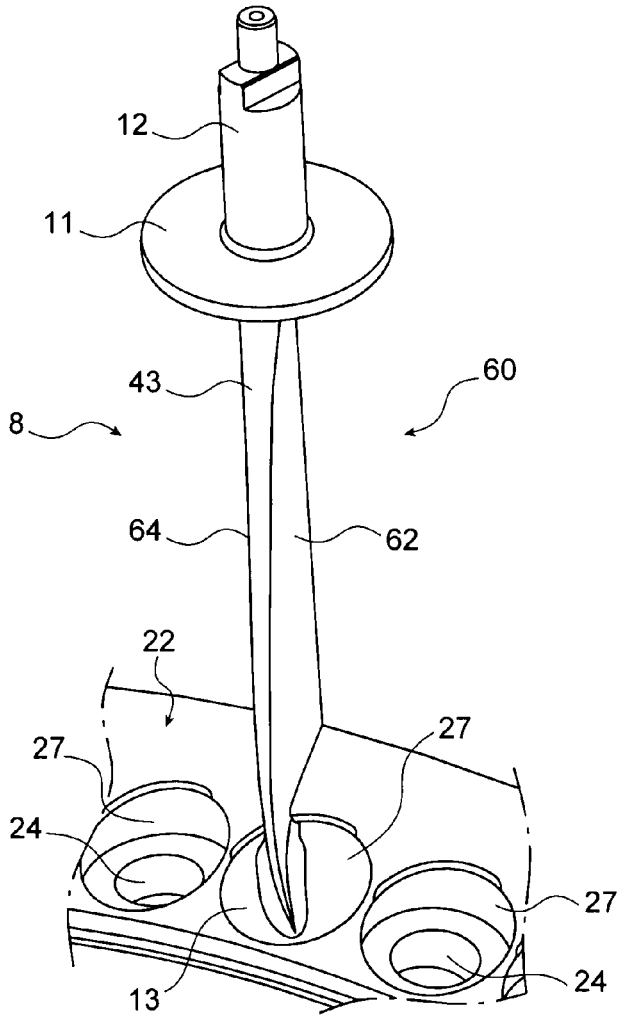
FIG. 3, previously described, represents a perspective view of a part of the assembly fitted to the stator stage shown in FIG. 2, where the assembly includes the stator vane ring and the vanes mounted on the latter (a single vane is represented)

Assembly 160 is also fitted with multiple vane base reception bushings (not represented), of the type of the one shown in FIG. 2, and the number of which is identical to the number of vanes of the stator stage, i.e. several tens. The bushings 26, held in the orifices 24, therefore succeed one another, being positioned beside one another along the entire length of the circumferential direction 40, over 360°.

Finally, the assembly 160 has multiple variable-pitch vanes 8, each one cooperating with two orifices 24, 27 and a housing held in orifice 24.

As previously mentioned, each vane 8 includes an active part of the vane 43 either side of which are positioned a radially inner platform 13 and a radially outer platform 11, and also including a first centering pin 12 extending radially towards the exterior from the platform 11, together with a centering pin (not visible in FIG. 4) extending radially towards the interior from platform 13, where these first and second centering pins define a common vane rotational axis.

Figure 5:
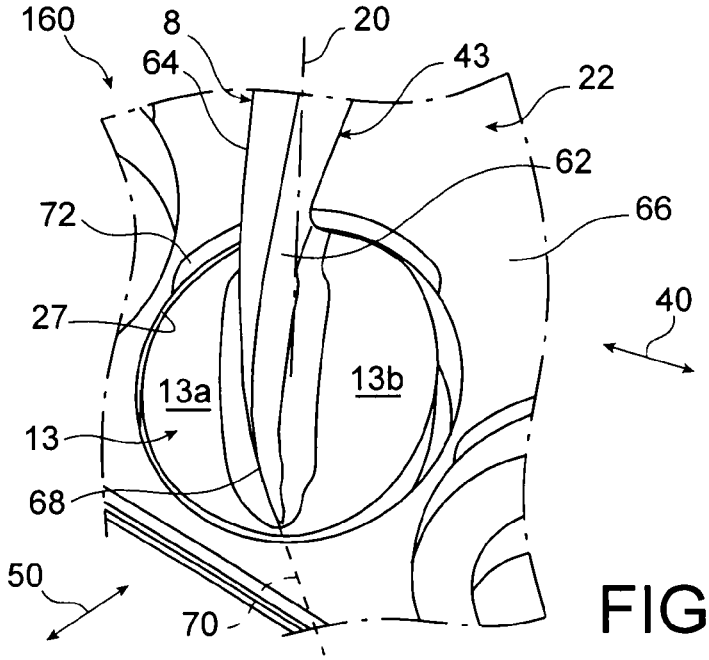
FIG. 5 represents an enlarged perspective view of a part of the assembly shown in FIG. 4.

Moreover, the active part of the vane 43 has a first surface forming a convex surface 64, and a second surface opposed to the first, forming a concave surface 62. The base of this active part of the vane 43 separates the radially inner platform 13 in a first part 13*a* positioned on the side of the convex surface 64, and a second part 13*b* positioned on the side of the concave surface 62, as can best be seen in FIG. 5. For information, it may be considered that in the area of the leading edge 68 of the active part of the vane the first and second parts 13*a*, 13*b* are demarcated by the extension of the skeleton line 70 of the base of the active part of the vane. Unlike this area, the demarcation is still made by the concave surface 62 and the convex surface 64, since the trailing edge of the active part of the vane extends well beyond platform 13. Moreover, due to this extension of the active part of the vane 43 beyond the platform, the orifice 27 has a slight bevel 72 in the area of its part likely to be covered by this active part of the vane.

The upper surface of the parts 13*a* and 13*b* of the inner platform 13 also constitute a part of the inner surface demarcating the principal airstream 66, which is preferably inclined relative to the axial direction and which, generally, is separated from the engine axis as one moves downstream.

Figure 6:
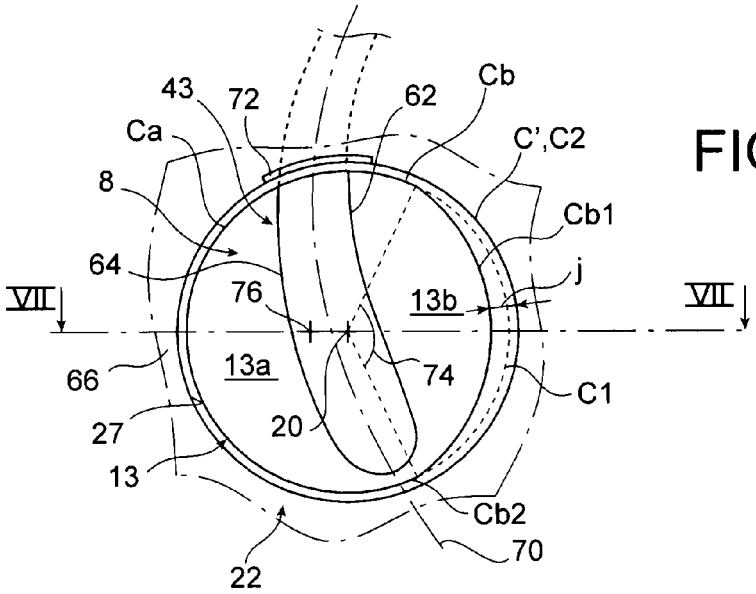
FIG. 6 is a top view along the axis of rotation of the vane shown in FIG. 5.

One of the features of the invention has been represented diagrammatically in FIG. 6, showing one of the vanes 8 mounted on the ring 22, seen along the direction of the rotational axis 20 of this vane. In this view, the first part 13*a* of platform 13, located on the convex side 64, has an outer outline referenced Ca, which is superimposed on a circle referenced C1, the centre of which corresponds to the axis 20. Due to the superimposition of the outline Ca and of the circle C1, these two elements are represented by the same circle arc line.

Moreover, at least one part Cb1 of the outer outline Cb of the second part 13*b* of the platform 13 is positioned at the distance of and within the abovementioned circle C1. In the represented preferred embodiment, the part Cb1 of the outline which is positioned within the circle C1 corresponds only to a portion of this outline referenced Cb, and the other part Cb2, for its part, is superimposed on the circle C1. As can be seen in FIG. 6, the part Cb2 can be that which extends continuously from both ends of the outline of the part Ca, whereas part Cb1 can extend over an angular sector 74, for example of the order of 120°, centred on the centre 20 of the circle C1. As an example, the part Cb1 of the outline Cb can take the form of a circle arc centred on a centre 76 offset from the centre 20 of the circle C1.

Platform 13, which results from the above geometrical definition, therefore has a general shape comparable to a cylindrical shape of circular section having a peripheral shrinkage of material in a portion of its second part 13*b*, in order that this portion is further from the orifice 27 than the other portions of this platform 13.

Figure 7:
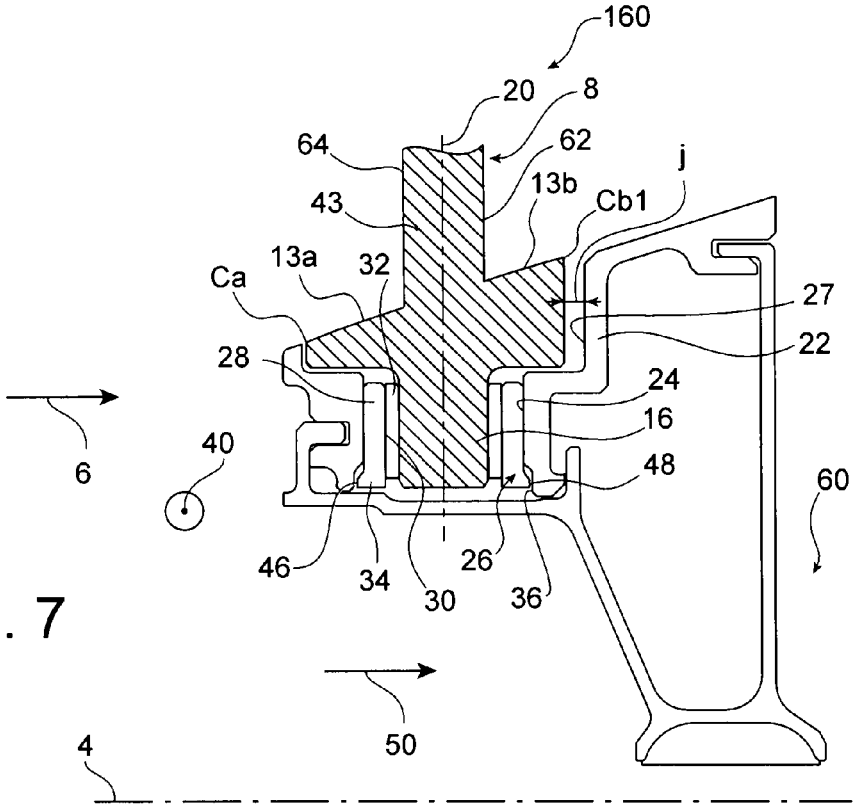
FIG. 7 represents a section view along line II-VII of FIG. 6.

Indeed, again with reference to FIG. 6, the holding orifice 27 of the radially inner platform 13 has an inner outline C' superimposed on a concentric circle C2 of diameter greater than the abovementioned circle C1. Consequently, when at rest, the first clearance separating the outline C' and the parts of outline Ca, Cb2 is roughly constant, for example of the order of 0.5 mm, and less than the second changing clearance "j" separating the outline C' from the outline part Cb1. This second clearance "j", also referenced in FIG. 7, is moreover roughly identical to the first clearance near the two junctions with the outline Cb2, and then increases gradually as it approaches the central portion of the outline part Cb1, where it reaches its maximum, for example of the order of 1.75 mm.

With this regard, the design can be such that the part Cb1 of the outline Cb, which is separated from the circle C1, is located at a maximum radial distance of this circle of between a value corresponding to 7% of the diameter of the circle C1 and a value corresponding to 1% of the diameter of this circle C1. It should be noted that the radial distance must naturally be understood as being the distance between the circle C1 and the outline Cb1 along a straight line passing through the centre 20 of the circle C1.

Thus, when in operation, vane 8 is subject to a deflection caused by the resultant of the aerodynamic forces acting on it, the consequence of which is to bring the outline Cb1 closer to the orifice 27, without causing any harmful friction in ring 22.

It is noted, preferably, that the lateral surface of the platform 13, defining the outlines Ca, Cb, is cylindrical along axis 20, just as, disregarding the bevel 72, the lateral surface of the holding orifice 27, defining the outline C', is also cylindrical along axis 20.

Naturally, various modifications can be made by the skilled man in the art to the invention which has just been described, solely as non-restrictive examples.

The invention claimed is:

1. A variable-pitch vane for a stator stage of a turbomachine module, comprising:

an active part of the vane, either side of which are arranged a radially inner platform and a radially outer platform; and a first centering pin which extends radially towards the outside from said radially outer platform, together with a second centering pin extending radially towards the inside from said radially inner platform, where said first and second centering pins define a common vane rotational axis, and where said active part of the vane, which has a first surface forming a convex surface, and a second surface forming a concave surface, separates said radially inner platform into a first part positioned on the side of the first vane surface and a second part positioned on the side of the second vane surface, wherein, seen along the direction of the vane's axis of rotation, said first part of the radially inner platform has an outer outline superimposed on a circle, at the distance of which, and inside which, is at least a part of the outer outline of said second part of the radially inner platform.

2. A vane according to claim 1, wherein the part of the outline of the radially inner platform, which is separated from said circle, extends over an angular sector of between 100 and 140°, centered on the center of said circle.

3. A vane according to claim 1, wherein the part of the outline of the radially inner platform, which is separated from said circle, is located at a maximum radial distance from said circle of between a value corresponding to 7% of the diameter of the circle, and a value corresponding to 1% of the diameter of this circle.

4. A stator stage assembly including multiple variable-pitch vanes according to claim 1, wherein said assembly includes a stator vane ring having, in association with each of said vanes, an orifice holding the radially inner platform of the vane, opening out into the area of an inner surface demarcating a principal airstream defined by the ring, together with an orifice holding a centering bushing of the vane in which is inserted said second centering pin such that, seen along a direction of the axis of rotation of the vane, said orifice holding the radially inner platform has an inner outline superimposed on a concentric circle, of diameter greater than said circle, on to which the outer outline of said first part of the radially inner platform is superimposed.

5. An assembly according to claim 4, wherein each radially inner platform also forms a part of said inner surface demarcating the principal airstream.

6. An assembly according to claim 4, wherein each centering bushing includes firstly a skirt inserted in said bushing holding orifice in the ring, and defining a seat of the second centering pin, and secondly a base coupled with said skirt, where said bushings, each extending in a bushing axis, succeed one another in a circumferential direction of said ring.

7. An assembly according to claim 6, wherein the base of each centering bushing is held in a circumferential groove of the ring, demarcated by two facing edges spaced relative to one another in an axial direction of the ring.

8. A stator stage with variable-pitch vanes for a turbomachine module, including an assembly according to claim 4.

9. A turbomachine module including at least one stator stage according to claim 8.

10. A module according to claim 9, wherein it is a compressor or a turbine.

11. A turbomachine including at least one module according to claim 9.

12. A method of manufacture of the variable-pitch vane for a turbomachine module stator stage, according to claim 1, wherein said radially inner platform is obtained from a shape of circular section, machined in its periphery so as to obtain said second part of this platform.

* * * * *

UNITED STATES PATENT AND TRADEMARK OFFICE

CERTIFICATE OF CORRECTION

PATENT NO. : 8,721,269 B2
APPLICATION NO. : 13/143652
DATED : May 13, 2014
INVENTOR(S) : Aude Abadie et al.

It is certified that error appears in the above-identified patent and that said Letters Patent is hereby corrected as shown below:

In the Specification:

Column 3, line 31, change “the that this shrinkage” to --the shrinkage--.

Signed and Sealed this
Fourteenth Day of October, 2014

Michelle K. Lee

Michelle K. Lee
*Deputy Director of the United States Patent and Trademark Office*